US011332860B2

(12) United States Patent
Mongardi et al.

(10) Patent No.: US 11,332,860 B2
(45) Date of Patent: May 17, 2022

(54) METHOD AND APPARATUS FOR FORMING A BRAIDED YARN COATING OVER A PRODUCT, AND PRODUCT THUS OBTAINED

(71) Applicant: ISOLET IND. S.R.L., Caselle Torinese (IT)

(72) Inventors: Maurizio Mongardi, Turin (IT); Alberto Castello, Turin (IT)

(73) Assignee: ISOLET IND. S.R.L., Caselle Torinese (IT)

( * ) Notice: Subject to any disclaimer, the term of this patent is extended or adjusted under 35 U.S.C. 154(b) by 33 days.

(21) Appl. No.: 16/633,864

(22) PCT Filed: Jul. 23, 2018

(86) PCT No.: PCT/IT2018/050136
§ 371 (c)(1),
(2) Date: Jan. 24, 2020

(87) PCT Pub. No.: WO2019/021330
PCT Pub. Date: Jan. 31, 2019

(65) Prior Publication Data

US 2020/0208312 A1 Jul. 2, 2020

(30) Foreign Application Priority Data

Jul. 27, 2017 (IT) ..... 102017000085688

(51) Int. Cl.
*D04C 3/12* (2006.01)
*D04C 1/06* (2006.01)
*D04C 3/48* (2006.01)

(52) U.S. Cl.
CPC ..... *D04C 3/12* (2013.01); *D04C 1/06* (2013.01); *D04C 3/48* (2013.01)

(58) Field of Classification Search
CPC ... D04C 1/06; D04C 3/12; D04C 3/48; A61M 25/0053
(Continued)

(56) References Cited

U.S. PATENT DOCUMENTS 698,490 A * 4/1902 Groebli ..... D04C 1/06 87/9
787,382 A * 4/1905 Klein ..... D04C 1/06 87/9
(Continued)

FOREIGN PATENT DOCUMENTS

JP 3267090 B2 3/2002

OTHER PUBLICATIONS

International Search Report and Written Opinion dated Oct. 23, 2018, for International Application No. PCT/IT2018/050136, 9 pages.

*Primary Examiner* — Shaun R Hurley
(74) *Attorney, Agent, or Firm* — Meunier Carlin & Curfman LLC

(57) ABSTRACT

A method of forming a braided coating over a product (2, 2A), in particular a flexible product such as a cable, a rope, a pipe, etc., is provided, in which the product (2, 2A), while leaving a coating zone (17) of a braiding machine (100), is submitted to a continuous rotation about its longitudinal axis. A braiding machine (100) for carrying out the method and a coated product obtained with the method are also provided.

8 Claims, 6 Drawing Sheets

(58) Field of Classification Search
USPC ..... 87/11
See application file for complete search history.

(56) References Cited

U.S. PATENT DOCUMENTS

| | | | | | |
|---|---|---|---|---|---|
| 1,780,515 | A * | 11/1930 | Berlin | D04C 1/06 | 87/8 |
| 5,417,138 | A * | 5/1995 | Morris, Jr. | D04C 3/48 | 87/31 |
| 5,979,288 | A * | 11/1999 | Gallagher | D04C 1/06 | 57/10 |
| 8,511,214 | B2 * | 8/2013 | Gries | D04C 1/06 | 87/34 |
| 8,877,661 | B2 * | 11/2014 | Kumpers | D04C 1/06 | 442/204 |
| 2009/0035529 | A1 | 2/2009 | Kumpers et al. | | |
| 2010/0052203 | A1 * | 3/2010 | Inazawa | D04C 3/48 | 264/103 |
| 2010/0083815 | A1 * | 4/2010 | Inazawa | D04C 3/48 | 87/1 |
| 2012/0271403 | A1 | 10/2012 | Gries | | |
| 2013/0305911 | A1 * | 11/2013 | Masson | D04C 3/34 | 87/9 |

* cited by examiner

METHOD AND APPARATUS FOR FORMING A BRAIDED YARN COATING OVER A PRODUCT, AND PRODUCT THUS OBTAINED

TECHNICAL FIELD

This invention relates to braiding methods and machines, and more particularly relates to a method of forming a braided yarn coating over a product, in particular a flexible product such as a cable, a rope, a pipe, etc., to an apparatus for carrying out the method and to the coated product obtained by means of such method and such apparatus.

PRIOR ART

It is well known to apply to products, such as ropes, cables, pipes, etc., braided coatings formed with yarn materials designed to give the product desired features. For example, with a suitable choice of materials, it is possible to give the product features of resistance to cutting, friction and traction, elasticity, electrical and/or thermal insulation or protection in general. The choice of yarn colours also allows providing special aesthetic effects. Obviously, in the finished product it is possible to combine technical features and aesthetic effects.

FIG. 1 shows a schematic representation of a conventional braiding machine, indicated as a whole by 1, for forming a braided coating over a product 2 which moves vertically through the braiding machine (vertical braiding machine).

The braiding machine 1 comprises a support frame 10 with a workbench 11 which carries a plurality of spindles 12, which are arranged in a circle around the product 2, e.g. a cable, and on which spools 13 of yarn 14 are arranged. The yarns 14 may differ from each other in material (and therefore in dynamical/mechanical features), colour, etc., and the spools 13 are arranged on the spindles 12 according to a configuration determined by the features of the coating to be formed. The spindles 12 are mounted in seats 15' on corresponding rotating bases 15, each of which rotates about an axis parallel to the axis of the product 2. The overall movement of the spindles 12 (and therefore of the spools 13) is such that they rotate about the product 2 and at the same time move, with a constant circular rotary movement, from the inside to the outside of the circle and vice versa, passing from a base 15 to the contiguous one. For this purpose, each base 15 has a number of seats 15' higher than that of the spindles actually present on it at each instant. The coordinated rotation movement of each base 15 is obtained by a kinematic system, not shown, driven by a control system, e.g. of a numerical type, also not represented, according to a suitable program.

The product 2 to be coated, coming from a feed drum 3 external to the braiding machine 1, is brought to the braiding machine 1 by a traction and guide system (of which, in the figure, only a pulley 16 is shown, which establishes the point of entrance of the product 2 in the braiding machine, i.e. the point where the path of the product 2 becomes vertical), passes through the workbench 11 and is made to pass through a hole or central passage 17 of the kinematic system of the braiding machine 1, where yarns 14 also converge. The hole or passage 17 thus creates the coating zone. The hole or passage 17 is formed e.g. in a bracket 18 carried by an upright 19 and is adapted to ensure that the axial position of the product 2 is maintained during the coating operation. The coated product 2A leaving the coating zone 17 is then brought to a take-up drum 4, also external to the braiding machine 1, by an appropriate traction and guide system, of which, in the figure, only a pulley 20 is indicated. The latter represents the exit point of the coated product 2A from the braiding machine 1 (i.e. the point where the product 2A leaves its vertical trajectory) and, in the drawing, is carried by a second bracket 21 also fixed to the upright 19.

The relative speeds of the rotation of each base 15 and of the advance of the product 2 determine the lay angles of the rightward- and leftward-twisted weft on the product and therefore, taking into account the materials of the various yarns 14, the mechanical properties of tensile strength, elasticity etc., as well as the aesthetic properties of the coating.

With the conventional braiding machine 1, the coating method essentially comprises the following steps:

1) positioning of the feed drum 3 with the product 2 to be coated;
2) installation of the spools 13 on the spindles 12 according to defined coating programs;
3) connection of the product 2 to the kinetic system of the braiding machine 1;
4) start of the motor of the braiding machine 1;
5) advance of the product 2 by tensile sliding through the coating zone 17;
6) start of the coordinated and synchronized rotary movement of the spindles 12 about the product 2, entering in a constant axial position and without radial movements;
7) creation of the braided coating of yarns 14;
8) collection of the coated product 2A on the take-up drum 4.

FIG. 2 shows the rightward-twisted weft 14A and the leftward-twisted weft 14B of the coating of a product 2 coated by using the conventional braiding machine 1. As it can be seen, the two wefts 14A, 14B are arranged at an angle $\alpha$ relative to each other and form an angle $\alpha/2$ with the axis of the product 2. The symmetry of the two wefts is maintained for the entire coating process, even in case of variation of the angle $\alpha$, and this causes the properties of the coating (and therefore those of the product) to remain constant throughout the product.

Now, there is a growing interest in products in which the dynamical/mechanical properties obtainable with the coating vary along the product. For example, it may be desirable to obtain ropes and/or cables having portions with high tensile strength (therefore practically inextensible) and portions with high elasticity, or having points of maximum load (breaking points), depending on the modules (i.e. on tensile strength) of the selected yarns, in positions distributed along the product (hence, portions with a lower resistance). These particular performances are required, for example, in nautical, sailing, aerodynamic, mountaineering applications, etc.

These variable properties require an independent variation, during the coating, of the lay angle of the rightward- and/or leftward-twisted wefts with respect to the axis of the product, and therefore cannot be obtained with conventional braiding machines.

US 2012/0271403 A1 describes a tubular structure, and a method for forming said structure, in which the tubular structure has at least one level of braided yarns, which form on the support a wave configuration generated by the rotation of a support on which the structure is formed about its longitudinal axis. This wave configuration creates zones characterised by an increase in elastic properties and/or in mechanical resistance.

US 2009/0035529 A1 describes an energy-absorbing textile structure, and a method for forming said structure, in which the textile structure has, along its extension, at least one region characterised by a variation in the fibre structure obtained by a rotation of a support of the textile structure about its longitudinal axis.

SUMMARY OF THE INVENTION

The invention provides a method in which a unidirectional or bidirectional rotation about its axis is imparted to the product at least while leaving the coating zone. In this way, the variation of the lay angle of both the rightward- and the leftward-twisted wefts of the coating, on the product to be coated will be obtained.

In a particular embodiment, the angle formed by one of said wefts with the axis of the product is substantially zero at least over a portion of the product length.

In a first embodiment, the rotation is a continuous unidirectional rotation, and is accompanied by a corresponding and synchronized rotation of the product along its entire path from a feed drum to the coating zone and from the coating zone to a take-up drum of the finished product.

In a second embodiment, the rotation is a bidirectional rotation, and comprises a rotation in a first direction, followed, at predetermined intervals, by a rotation in the opposite direction to the first. Such bidirectional rotation is accompanied by the corresponding and synchronized rotation of the product, as in the case of unidirectional rotation, when the distance between the point of entrance of the product into the braiding machine and the coating zone is limited. The durations of rotation periods in either direction, and the rotation speeds in either direction, can be different from one another.

In the case of both the unidirectional and the bidirectional rotation, the ratio between the rotation speed and the feed rate of the product can be varied during the braiding operation.

According to a further embodiment, the unidirectional or bidirectional rotation of the product is applied simultaneously to the product entering the coating zone and to the product leaving the coating zone, by a corresponding rotation, about the product itself, of the set of spindles carrying the coating yarn.

Also in this further embodiment, does apply what has been said for the foregoing embodiments about the durations of the rotation periods and the rotation speeds in either direction of the bidirectional rotation and about the ratio between the rotation speed and the feed rate in both types of rotation.

The invention also provides an apparatus for carrying out the method according to the invention.

In an embodiment of the apparatus, at the exit from the coating zone, a mechanism is provided for causing a unidirectional or bidirectional continuous rotation of the product about its axis.

Advantageously, the mechanism includes:

- a worm screw reducer with speed and direction control, which is programmed to make the worm screw rotate either according to a continuous unidirectional rotary movement or according to a bidirectional rotary movement characterized by an inversion of the direction of rotation at predetermined intervals; and
- means for radially positioning the product being processed.

Preferably, the means for radially positioning include a toothed wheel with which the worm screw meshes, and a set of pulleys, of the type without axial constraints, which follow one another along the path of the product leaving the coating zone and are fixedly connected to a rotary support integrally rotating with the toothed wheel and fastened to the latter in an off-axis position.

According to an advantageous feature of this embodiment of the invention, means are also provided for imparting to the drum feeding the product to the braiding machine and to the drum collecting the coated product a rotation about an axis perpendicular to the axis of the drum, in a direction and with a speed corresponding to the direction and speed of the rotation imparted to the product. The means for rotating the drums are always activated in the case of unidirectional rotation, and, in the case of bidirectional rotation, are activated in the case of short distances between the point of entry/exit of the product in/from the machine and the zone of application of the rotation movement.

In a second embodiment of the apparatus, there are provided:

- a support element for the set of spindles carrying the coating yarn, hinged in the apparatus along an axis coinciding with the axis of the product in its path inside the apparatus, so as to be able to perform a movement of unidirectional continuous rotation or a bidirectional rotation movement, in which an inversion of the direction of rotation occurs at predetermined intervals; and
- motors with speed and direction control associated with said support element and adapted to impart said unidirectional or bidirectional rotation thereto.

The invention also relates to a coated product obtained with the method and the apparatus according to the invention, in which the rightward- and the leftward-twisted wefts form, with the axis of the product being processed, angles which are different from each other and possibly variable. In a preferred embodiment, one of said wefts forms a substantially zero angle with the axis of the product, at least over a portion of the product length.

BRIEF DESCRIPTION OF THE FIGURES

These and other features and advantages of the present invention will become clear from the following description of preferred embodiments made by way of non-limiting example with reference to the accompanying drawings, in which.

In all Figures, identical or functionally equivalent elements are indicated with the same reference numbers.

DESCRIPTION OF PREFERRED EMBODIMENTS

Figure 1:
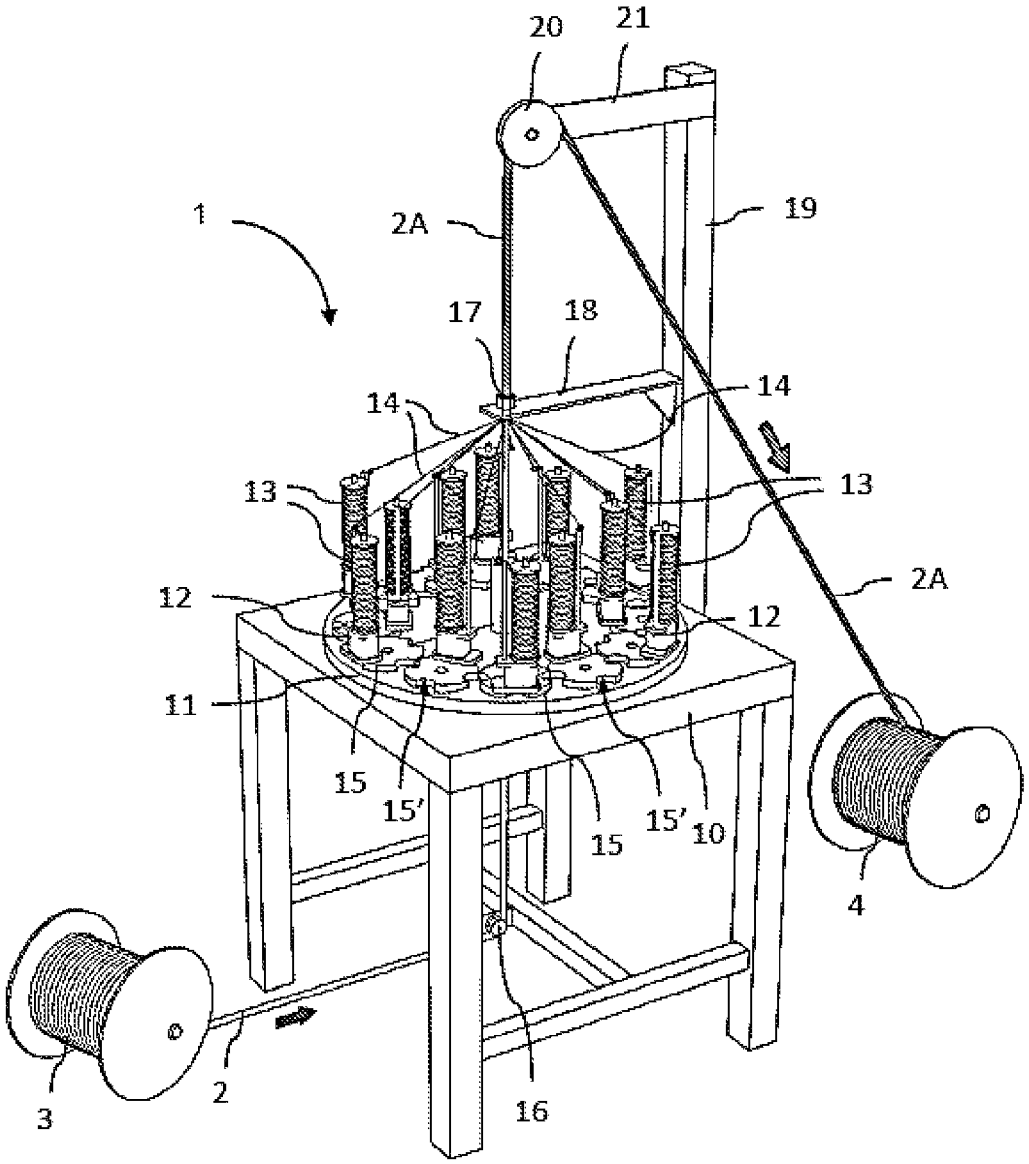
FIG. 1 is a schematic view of a conventional braiding machine.
Figure 2:
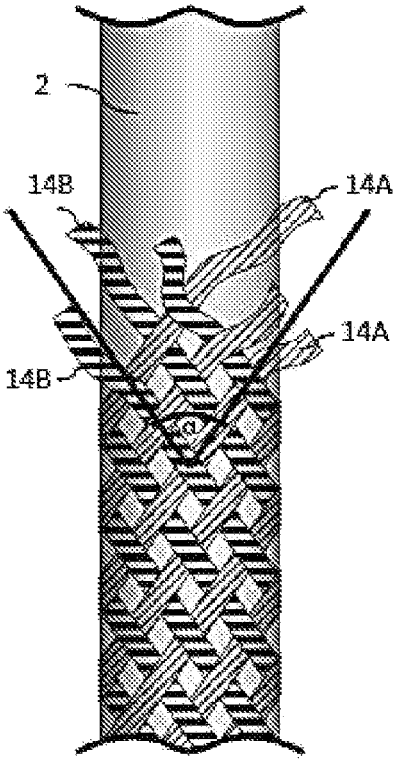
FIG. 2 shows the pattern of the rightward- and leftward-twisted wefts of the coating in a coated product obtained with the braiding machine of FIG. 1.
Figure 3:
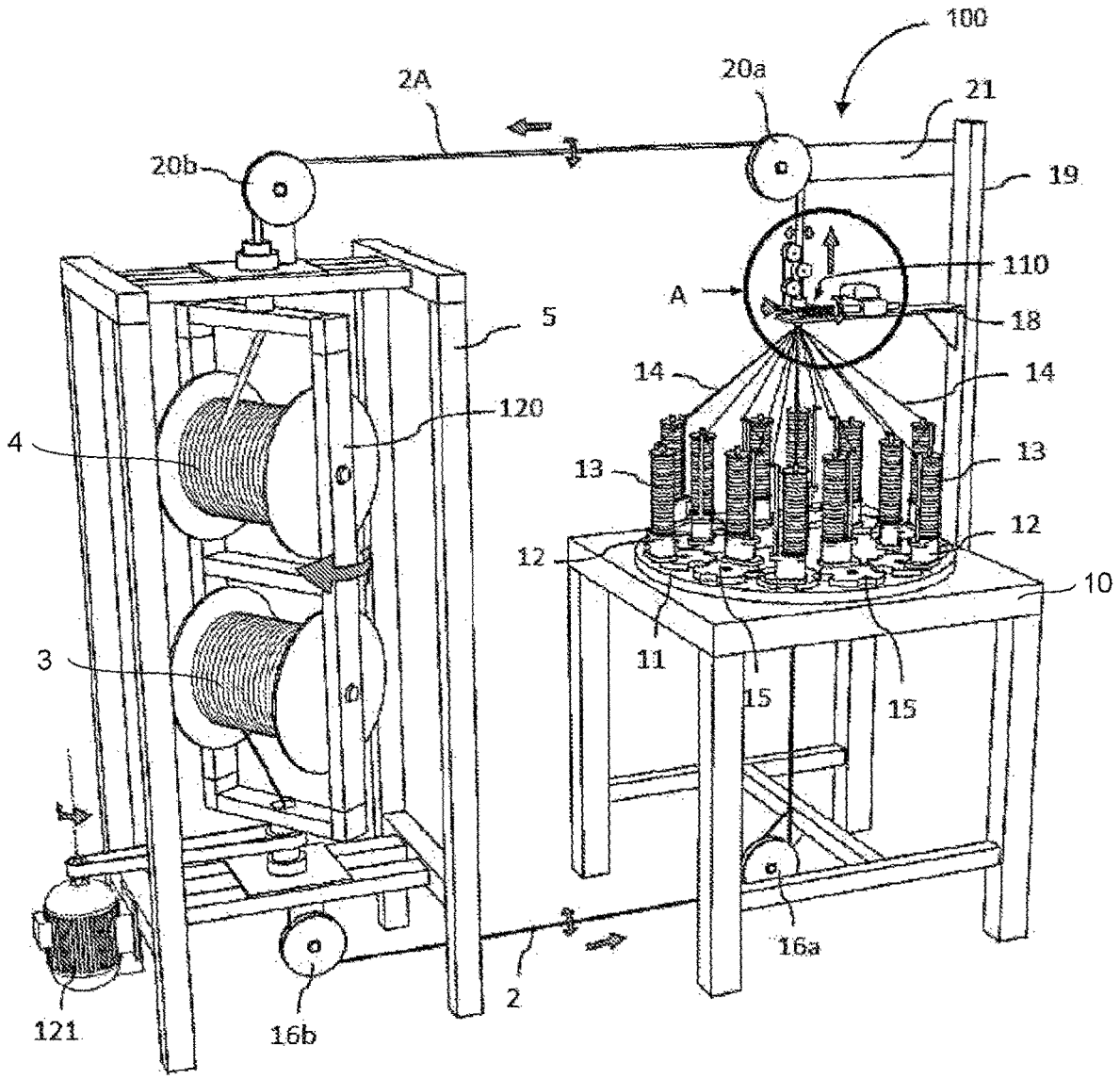
FIG. 3 is a schematic view of a first embodiment of a braiding machine according to the invention.

FIG. 3 shows a braiding machine according to a first embodiment of the invention, indicated as a whole with 100. FIG. 3 still illustrates a vertical braiding machine, designed to coat products of limited weight and/or length, so that the feed and take-up drums 3, 4 can be mounted in a common support frame 5. The guide systems for delivering the product 2 to be coated to the braiding machine 100 and the coated product 2A to the take-up drum 4 comprise in this case, in addition to the pulleys 16*a*, 20*a* corresponding to the pulleys 16, 20 of FIG. 1, also pulleys 16*b*, 20*b* in correspondence of the frame 5.

The braiding machine 100 comprises all elements of the conventional braiding machine 1 and, in addition, a mechanism 110, placed at the exit of the coating zone 17, to impart to the product 2, 2A a unidirectional or bidirectional continuous rotation about its axis.

As can be seen more clearly in FIG. 3, the mechanism 110 includes:

- a worm screw reducer, comprising the worm screw 112 and a support 111 with speed and direction control for said screw, the support 111 being programmed to rotate the worm screw 112 either according to an unidirectional continuous rotation movement or according to a bidirectional rotation movement in which there is an inversion of the direction of rotation at predetermined intervals;
- a toothed wheel 113, coaxial with the axis of the product 2, 2A, which is made to rotate in either direction by the worm screw 112;
- a group of pulleys 114 without axial constraints, between which the product being processed 2A leaving the coating zone 17 is made to pass and which are carried by an upright 115, fixed to the toothed wheel 113 in an off-axis position and rotating integrally with the wheel 113.

With this arrangement, as it is immediately understood, a rotation imparted to the toothed wheel 113 by means of the worm screw reducer 111, 112 turns into a corresponding rotation of the product 2A about its axis.

According to the type of rotation imparted to the product leaving the coating zone 17, it may be necessary to accompany this rotation with a corresponding rotation of the product portions comprised between the feed drum 3 and the point of entrance 16*a* in the braiding machine 100 and between the exit point 20*a* from the braiding machine 100 and the take-up drum 4, to prevent the product 2, 2A from twisting in an undesired manner during processing.

For this purpose, the drums 3, 4 are mounted in a common cage 120 hinged on the frame 5 along an axis perpendicular to the axis of the drums 3, 4 (therefore an axis parallel to the axis of the product 2, 2A inside the braiding machine 100). The cage 120 is associated with a motor 121 with speed and direction control, adapted to impart to the cage 120 a rotary movement in the same direction as the rotary movement imparted by the mechanism 110 and synchronized with it (by an electric axis).

In the case of unidirectional rotation, the rotation of the cage 120 is always necessary. In the case of bidirectional rotation, the rotation of the cage 120 is only necessary when the distance between the point of entrance 16*a* into the braiding machine 100 and the coating zone 17 is limited. In the case of relatively large distances, the alternate rotation in either direction imparted to the product by the mechanism 110 can be absorbed by the product 2, 2A without the need to rotate the cage 120.

With the braiding machine 100, the coating method takes place as follows.

The initial steps are the same as steps 1-4 of the method described for the conventional braiding machine 1. Once the motor of the braiding machine 100 has been started, the method differs according to the desired final product.

In particular, for a product to be coated with unidirectional rotation, the subsequent steps are:

5a) starting the motor 121 of the drums-carrying cage 120 and the worm screw reducer 111, 112;

6a) feeding the product 2 to the coating zone 17 with a stable and continuous unidirectional rotary movement;

7a) maintaining the unidirectional movement with the worm screw reducer 111, 112;

8a) starting the forced rotary movement of the spindles 12, coordinated and synchronized, about the product 2 and creation of the braided coating of yarns 14;

9a) making the coated product 2A exit and pass through the pulleys without axial constraints 113 for positioning the product and maintaining the degree and speed of rotation;

10a) collecting the coated product 2A on the take-up drum 4 disposed inside the cage 120.

For a product to be coated with bidirectional rotation, it is necessary to take into account, as mentioned, the distance between the point of entrance 16*a* into the braiding machine 100 and the coating zone 17.

In the case of limited distance, the method is similar to that described for the case of unidirectional rotation, except that the rotation imparted by the motor 121 and by the reducer 111, 112 changes direction at programmed intervals.

In the case of relatively high distances, the operations of steps 5a-7a become:

5b) starting the motor of the worm screw reducer 111, 112;

6b) feeding the product 2 to the coating zone 17;

7b) inducing a bidirectional movement with the worm screw reducer 111, 112.

The subsequent steps are identical to steps 8a-10a.

The rotation of the product being processed about its longitudinal axis allows obtaining lay angles of the rightward- and/or leftward-twisted wefts with respect to the product axis that are different and variable along the product, and this allows varying along the product the dynamical and mechanical properties obtainable with the coating. This effect will be further discussed below.

Figure 5:
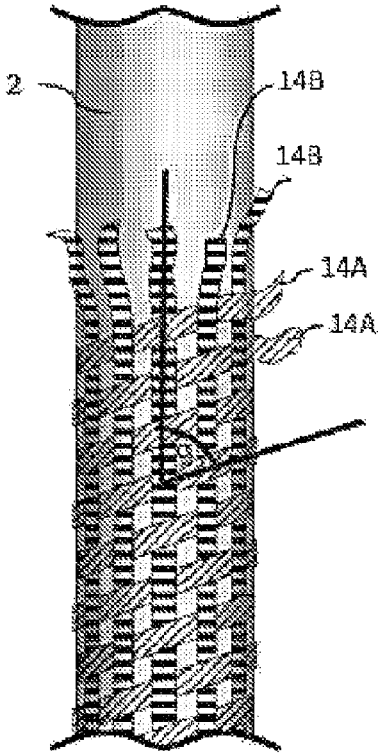
FIG. 5 is a view similar to FIG. 2 and shows the pattern of the rightward- and leftward-twisted wefts of an example of coating made with the braiding machine according to the invention, in a particular case of unidirectional longitudinal rotation.

FIG. 5 shows the pattern of the rightward- and leftward-twisted wefts of a coating obtained with the unidirectional longitudinal rotation of the product being processed. The Figure clearly shows how the rightward-twisted weft 14A and the leftward-twisted weft 14B form different lay angles with the product axis. In particular, the Figure shows an extreme case, in which the lay angle of one of the wefts, for example the leftward-twisted weft 14B, is substantially zero, whereas the weft 14A continues to form the angle $\alpha$ with the considered weft, and therefore substantially forms the angle $\alpha$ also with the axis of the product.

Figure 6:
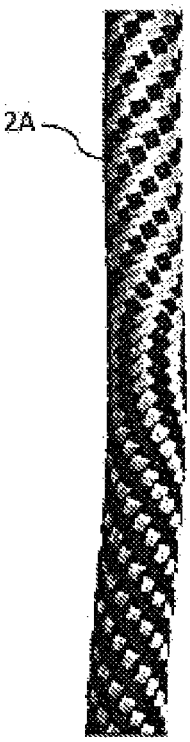
FIG. 6 is a front view of a portion of a product coated with the braiding machine according to the invention, in the case of bidirectional longitudinal rotation.
Figure 4:
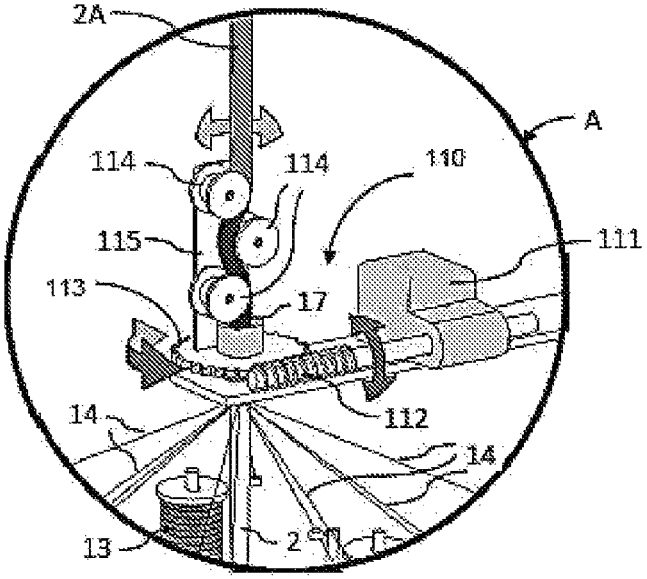
FIG. 4 is an enlarged view of the detail enclosed in circle A in FIG. 3.

FIG. 6 shows, instead, a portion of the finished product obtained with the bidirectional rotation of the product being processed. For the sake of clarity, a coating is shown with only two types of yarn, one light yarn in one of the wefts and one dark yarn in the other weft. It can be seen that it is possible to vary the angle of the wefts along the product in order to obtain, in addition to the technical effect mentioned above, also aesthetic effects not obtainable with the standard method. Clearly, such aesthetic effects will be enhanced by the use of different yarns of different colours, suitably arranged in the wefts.

In the foregoing, a vertical braiding machine is illustrated, in which the drums 3, 4 feeding and taking up the product are mounted in a common cage 120.

Figure 7A:
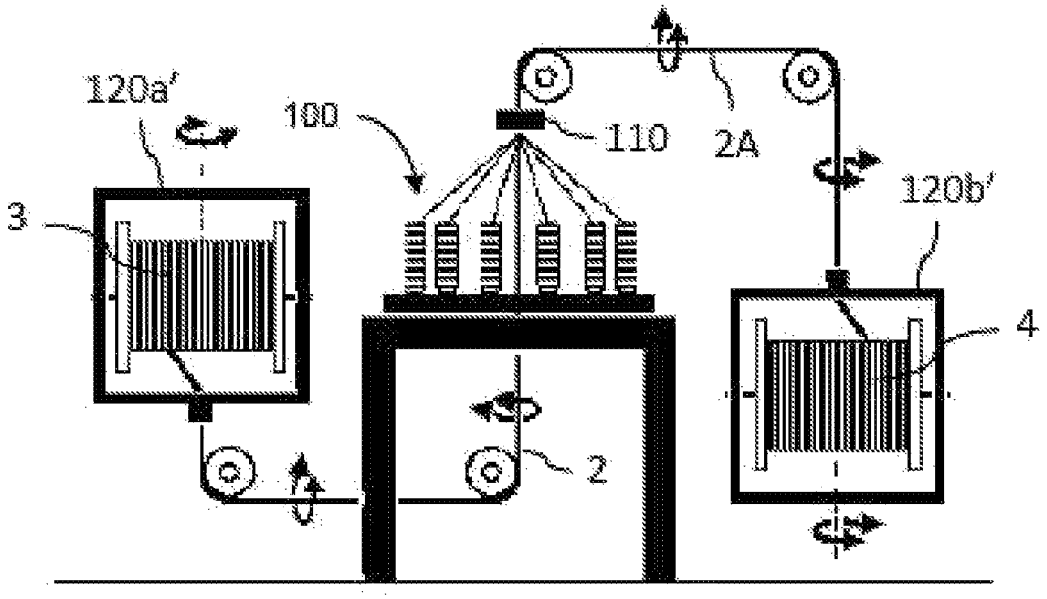
FIGS. 7A, 7B show two alternative mounting configurations for the braiding machine according to FIG. 3.

In a first alternative embodiment, shown in FIG. 7A, the braiding machine 100' is still a vertical braiding machine, but the overall mass of product to be obtained requires the use of separate frames, and therefore of separate cages 120*a*', 120*b*', for the feed and take-up drums 3, 4.

Figure 7B:
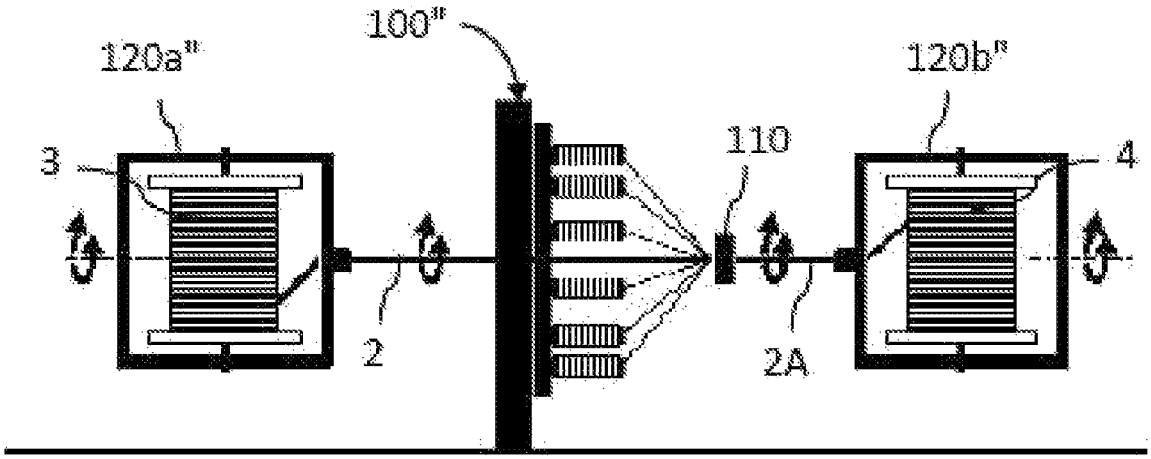

In a second alternative embodiment, shown in FIG. 7B, the braiding machine 100" is a horizontal-axis braiding machine, which also requires mounting the drums 3, 4 in separate cages 120*a*" and 120*b*". The motors for moving the cages 120*a*', 120*b*' and 120*a*", 120*b*" and possible pulleys for guiding the product in the case of the horizontal braiding machine 100" are not shown for the sake of simplicity. Clearly, it would be possible to have a horizontal-axis braiding machine with drums mounted on a common frame.

Some considerations on the technical effects obtained with the invention will now be made.

In general terms, by diversifying the geometry of the yarns in the rightward- and leftward-twisted wefts of the coating, it is possible to obtain different behaviours with regard to mechanical stresses, especially axial stresses. By using yarns resistant to high tensile loads, the continuous unidirectional rotation will allow obtaining a high inextensibility of the coating, while the bidirectional rotation will allow obtaining controlled elongation and breaking capability. The high inextensibility in the case of the unidirectional rotation is due to the axial arrangement of one of the two wefts present in the braided coating, for example the weft 14B, as illustrated in FIG. 5. The axial rotation in a stable and continuous manner in a single direction decreases the lay angle of the weft 14B on the surface of the product 2 to be coated, and this angle can be accurately controlled by the numerical control of the braiding machine 100 with an appropriate combination of translation and rotation speeds, which makes the weft 14B substantially "parallel" to the axis of the entering product 2. The other weft 14A will continue to form the acute angle $\alpha$ with the considered weft.

In the case of bidirectional rotation, the programmed inversion of the rotation direction allows, instead, managing with extreme precision the formation of a breaking point under load of the system, also in this case by suitably managing the lay angles of the yarns. By inducing the direction inversion at programmed intervals, it is possible to distribute the necessary breaking points in a controlled sequence of elongations, such as in applications to aerodynamic braking cables.

The results are then transferred, as is known by a skilled in the art, to the finished product, which therefore assumes the desired features.

An extreme example can be making one of the wefts (for example the rightward-twisted weft 14A) with elastic yarn (e.g. latex), and the other weft 14B with inextensible yarn (for example, Kevlar® or the like). By carefully choosing the geometry of the braiding, one can control the point and the magnitude of the variation of the dynamical/mechanical features of the final product. By varying the angle of incidence of the braided yarns on the product being processed, it is possible to obtain an increase or decrease in percentage of certain features of elongation, tensile strength, etc. Moreover, thanks to the subtlety of control and the flexibility inherent in the current numerical controls, infinite possibilities of variation of the result and therefore of its final application are obtained.

Always considering such an extreme case, by approaching the laying of the inextensible yarn to the axial direction of the product, the maximum load available, without dimensional variations, will be obtained. On the contrary, if the laying of the elastic yarn is approached to the axial direction, the maximum possible extensibility will be obtained.

It will be noted that it is not possible to arrive at the total rupture of the product, since, even in the second case, the inextensible spirally woven yarn in any case determines a maximum load.

A correct application and choice of yarns allow infinite possibilities of calibrating the mechanical (elastic-dimensional) effects and a precise positioning of the desired effect in the required product length, as well as the repetition capacity in the product development.

Figure 8:
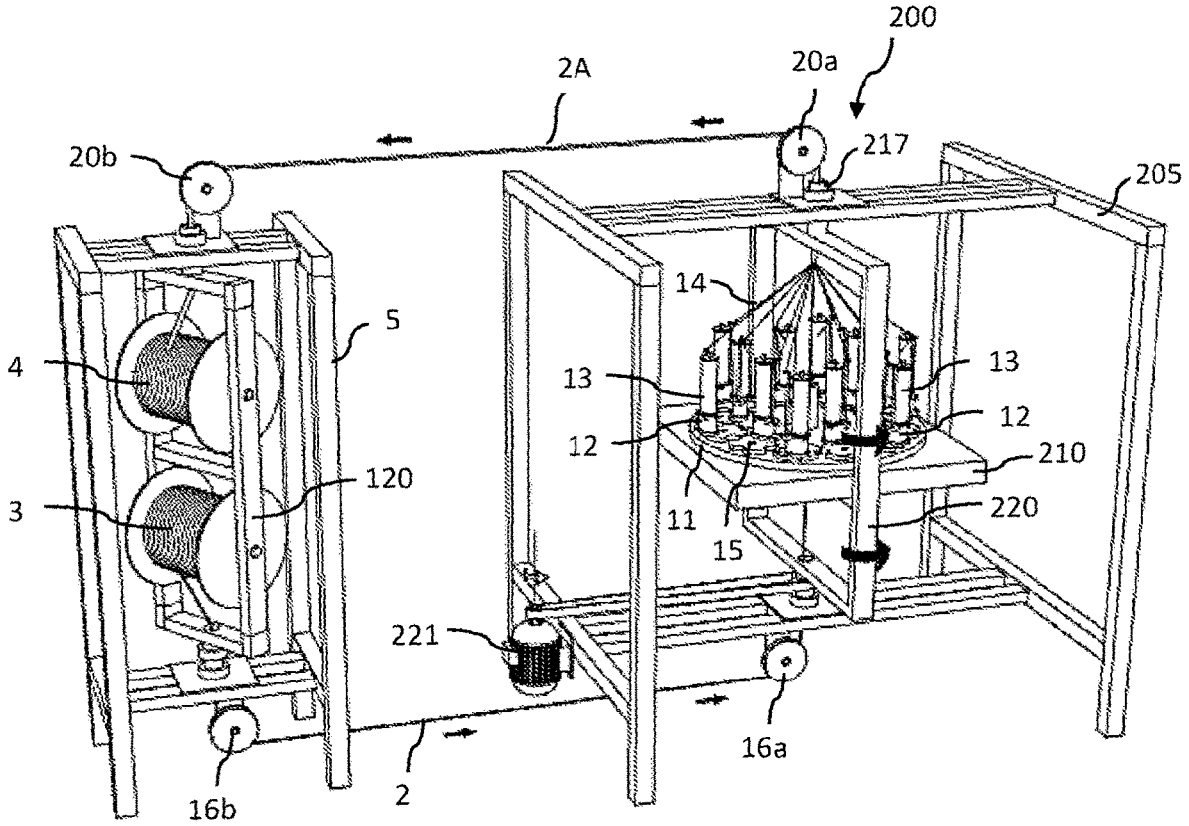
FIG. 8 is a view similar to FIG. 3, which shows a second embodiment of the braiding machine according to the invention.

In FIG. 8, there is shown a second embodiment of the braiding machine according to the invention, indicated as a whole by 200. Like the braiding machine 100 of FIG. 3, the braiding machine 200 is a vertical braiding machine designed to coat products of limited weight and/or length, whose feed and take-up drums 3, 4 are mounted in a common support frame 5.

In this embodiment, the unidirectional or bidirectional rotation of the product 2, 2A about its longitudinal axis is obtained by a corresponding rotation of the workbench 11 carrying the spindles 12. For this purpose, said workbench 11 is carried by a support base 210 fixed to a cage 220, hinged on a frame 205 of the braiding machine 200 along an axis coinciding with the axis of the product 2, 2A in its path inside the braiding machine 200.

The cage 220 is associated with a motor 221 with speed and direction control, in order to impart to the cage the desired unidirectional or bidirectional rotation about the hinge axis and therefore about the product 2.

Here, the central hole or passage 217 which forms the coating zone passes through the upper part of the cage 220 and of the frame 205.

With the braiding machine 200, the initial steps of the coating process are still the same as steps 1-4 of the process described for the conventional braiding machine 1. Once the motor of the braiding machine 200 has been started, the process continues with the following steps:

5c) starting the motor 221 associated with the cage 220 of the braiding machine to cause a unidirectional or bidirectional rotation of the cage itself; and 6c) feeding the product 2 by means of tensile sliding through the coating zone 217, while the product itself rotates about its axis due to the rotation of the cage 220.

The subsequent steps are identical to steps 8a-10a of the first embodiment.

With this arrangement, the additional mechanism 110, located at the coating zone in the embodiment according to FIGS. 3 to 7 is eliminated, so that the product 2, 2A is subject only to the tensile forces necessary to make it pass through the braiding machine and collect it with the take-up drum 4. In addition, the structure is also freed from constraints on the ground. The overall structure is therefore simpler than that of the first embodiment, although it allows obtaining the same results in terms of specific features of the coated product (in particular, a coating in which one of the two frames forms a substantially zero angle with the longitudinal axis of the product itself).

Note that in FIG. 8 a drum-holding cage 120 hinged on the frame 5 is still shown, even if the rotation of the drums 3, 4 is no longer necessary. In fact, it could also be assumed to build the braiding machine in such a way that the rotation of the product can be obtained, at the user's choice, according to either embodiment. In this case rotating cages will be provided, possibly associated both with a control motor, to support both the drums 3, 4 and the plate 11 carrying the spindles, and the mechanism 110 may be an accessory to be plugged into the cage 220 or the frame 205 when desired.

Figure 9A:
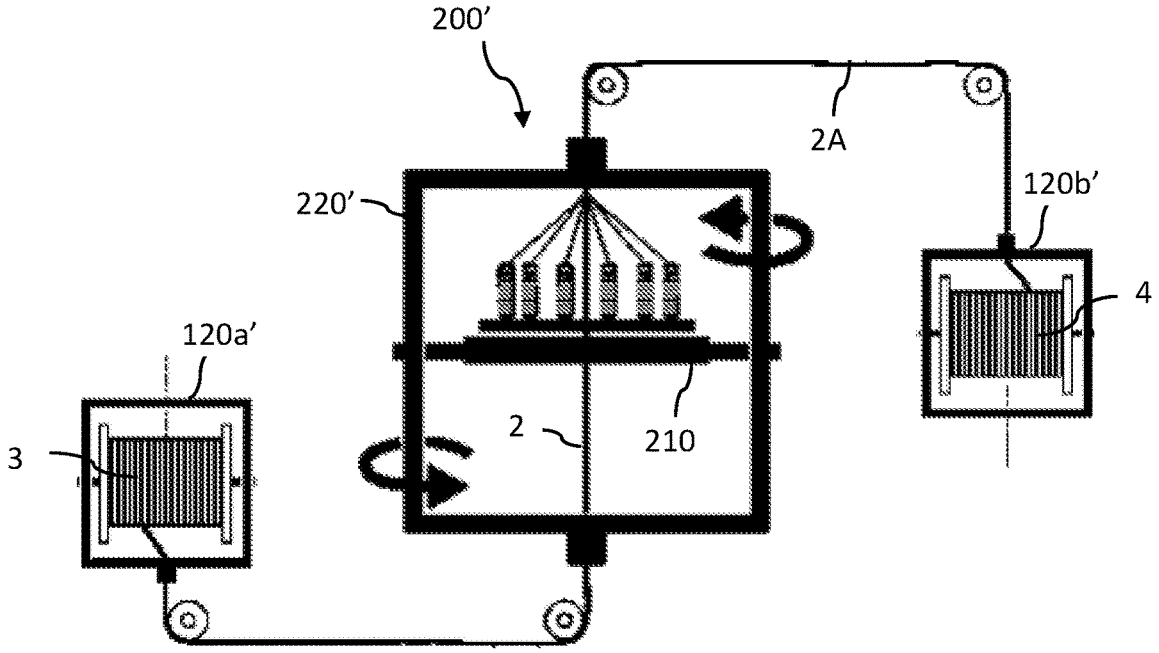
FIGS. 9A, 9B are views similar to FIGS. 7A, 7B, showing two alternative mounting configurations for the braiding machine according to FIG. 8.
Figure 9B:
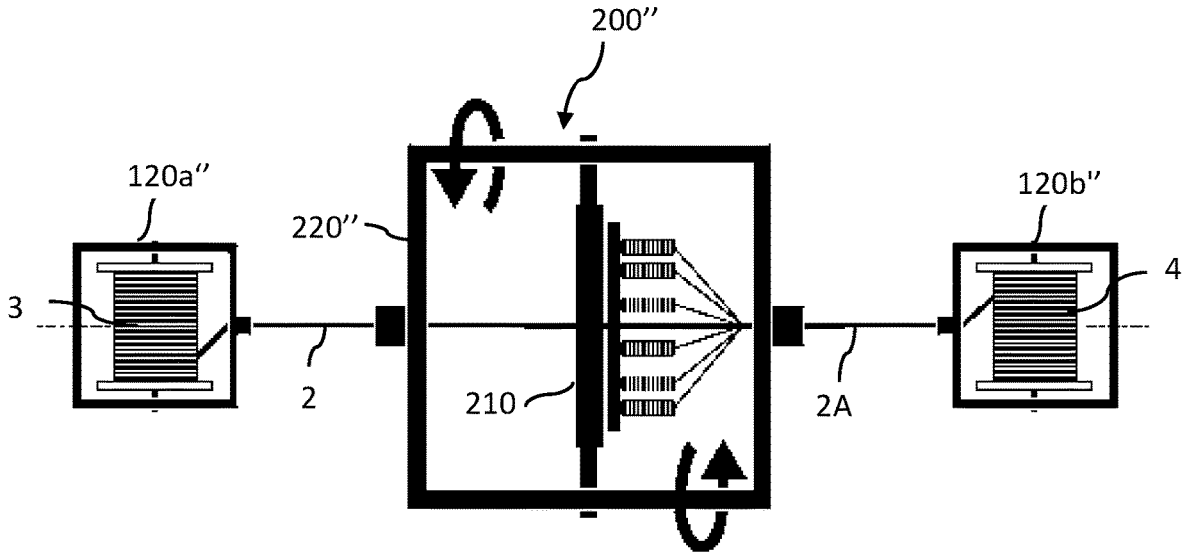

With reference to FIGS. 9A, 9B, also for the braiding machine according to FIG. 8, alternative mounting configurations similar to those shown in FIGS. 7A, 7B may be provided. In particular, the braiding machine 200' according to FIG. 9A still has a cage 220' hinged along a vertical axis, but the total mass of product to be obtained requires the use of separate frames (shown here again as rotatable cages 120*a*', 120*b*') for the feed and take-up drums 3, 4. The braiding machine 200" according to FIG. 9B has instead a cage 220" hinged along a horizontal axis and, in the illustrated example, also requires the mounting of the drums 3, 4 in separate cages 120*a*", 120*b*". Clearly, also in this case it is possible to have a horizontal axis braiding machine with drums mounted on a common frame or cage.

It is evident that what is described is given only as a non-limiting example and that variations and modifications are possible without departing from the scope of the invention, as defined by the following claims.

The invention claimed is:

1. A method of forming a braided yarn coating over a product having a longitudinal axis, wherein the product, while leaving a coating zone of a braiding apparatus, is submitted to a continuous unidirectional or bidirectional rotation about its longitudinal axis, wherein said product is a flexible product, and in that said rotation, at least in case of a unidirectional rotation, is accompanied by a corresponding and synchronized rotation of the product along a whole path thereof between means feeding the braiding apparatus with the product to be coated and the coating zone and between the latter and means collecting the coated product.

2. The method according to claim 1, wherein a rotation speed of the product and a translation speed of the same through the braiding apparatus are adjusted so that the angle formed by a rightward-twisted weft or a leftward-twisted weft with the axis of the product is substantially zero.

3. The method according to claim 1, wherein the rotation speed of the product is variable and, in case of bidirectional rotation, the rotation speeds in the first and second direction are different from each other.

4. The method according to claim 1, wherein the bidirectional rotation is obtained by alternating, at programmed levels, a rotation in a first direction and a rotation in a second direction opposite to the first.

5. The method according to claim 4, wherein the bidirectional rotation is accompanied by a corresponding and synchronized rotation of the product along the whole path thereof between the means feeding the braiding apparatus with the product to be coated and the coating zone and between the latter and the means collecting the coated product when the distance between a point of entrance of the product into the apparatus and the coating zone is limited.

6. An apparatus for forming a braided yarn coating over a product having a longitudinal axis, including a mechanism, placed along the path of the coated product at an exit from a coating zone of the apparatus, for imparting a continuous unidirectional or bidirectional rotation to the product about its longitudinal axis, wherein said mechanism includes:

a worm screw reducer with speed and direction control, which is programmed to make the worm screw rotate either according to a continuous unidirectional rotary movement or according to a bidirectional rotary movement obtained by alternating, at programmed intervals, a rotation in a first direction and a rotation in a second direction opposed to the first; and means for radially positioning the product leaving the coating zone.

7. The apparatus according to claim 6, wherein the radially positioning means include:

a toothed wheel, which is coaxially passed through by the product and with which the worm screw meshes in order to make it rotate about its axis; and a set of pulleys, which follow one another along the path of the product leaving the coating zone and between which said product passes, the pulleys being carried by a support fixedly connected for rotation to said toothed wheel and fastened to the latter in an off-axis position.

8. The apparatus according to claim 6, wherein said product is a flexible product, and wherein motors with speed and direction control are further provided in order to impart to means feeding the braiding apparatus with the product to be coated and to means collecting the coated product, at least in case of a unidirectional rotation of the product, a rotation corresponding to the rotation imparted by said mechanism and synchronized therewith.

* * * * *